US006412382B1

(12) United States Patent
Conley

(10) Patent No.: US 6,412,382 B1
(45) Date of Patent: Jul. 2, 2002

(54) SHINGLE CUTTER

(76) Inventor: Michael E. Conley, 5620 Rt. 245, North Lewisburg, OH (US) 43060

( * ) Notice: Subject to any disclaimer, the term of this patent is extended or adjusted under 35 U.S.C. 154(b) by 0 days.

(21) Appl. No.: 09/639,928

(22) Filed: Aug. 17, 2000

Related U.S. Application Data

(60) Provisional application No. 60/201,759, filed on May 4, 2000.

(51) Int. Cl.[7] ..... B26D 1/18; B26D 1/20; B26D 7/01

(52) U.S. Cl. ..... 83/468.4; 83/468.2; 83/488; 83/614; 83/629; 83/640; 83/920

(58) Field of Search ..... 83/629, 614, 627, 83/633, 605, 640, 641, 488, 489, 503, 468.4, 468.1, 468.2, 920

(56) References Cited

U.S. PATENT DOCUMENTS

| | | | | | |
|---|---|---|---|---|---|
| 7,584 | A | * | 8/1850 | Ruggles | 83/488 X |
| 86,611 | A | * | 2/1869 | Walker | 83/614 X |
| 516,026 | A | * | 3/1894 | Seaver | 83/489 |
| 2,294,335 | A | * | 8/1942 | Gilbert | 83/614 |
| 2,626,665 | A | * | 1/1953 | Chamberlain | 83/489 |
| 2,765,037 | A | * | 10/1956 | McDonough et al. | 83/489 |
| 2,823,749 | A | * | 2/1958 | Chamberlain | 83/489 X |
| 2,833,350 | A | * | 5/1958 | Merkur | 83/614 X |
| 2,846,005 | A | * | 8/1958 | Wilson | 83/488 X |
| 3,209,635 | A | * | 10/1965 | Auld | 83/488 X |
| 3,527,131 | A | * | 9/1970 | Ellerin et al. | 83/614 X |
| 3,821,915 | A | * | 7/1974 | Larrable | 83/489 X |
| 4,038,751 | A | * | 8/1977 | Albright | 83/614 X |
| 4,470,331 | A | * | 9/1984 | Eiting et al. | 83/503 X |
| 4,679,476 | A | * | 7/1987 | Abreu | 83/614 X |
| 4,951,539 | A | * | 8/1990 | Buckner | 83/884 |
| 4,951,540 | A | | 8/1990 | Cross et al. | 83/397 |
| 4,967,628 | A | * | 11/1990 | Judd et al. | 83/614 X |
| 5,046,392 | A | * | 9/1991 | Keon et al. | 83/614 X |
| 5,050,473 | A | * | 9/1991 | Ingram et al. | 83/468.4 X |
| 5,052,256 | A | | 10/1991 | Morrissey | 83/468 |
| 5,146,823 | A | * | 9/1992 | Holmes | 83/614 X |
| 5,165,314 | A | | 11/1992 | Paulson et al. | 83/29 |
| 5,249,495 | A | | 10/1993 | Renk | 83/468.3 |
| 5,272,947 | A | * | 12/1993 | Peters | 83/614 X |
| 5,322,001 | A | | 6/1994 | Boda | 83/485 |
| 5,644,963 | A | | 7/1997 | Fountas | 83/454 |
| 5,787,781 | A | | 8/1998 | Hile | 83/467.1 |

* cited by examiner

*Primary Examiner*—Charles Goodman
(74) *Attorney, Agent, or Firm*—Richard C. Litman

(57) ABSTRACT

A shingle cutter that is portable and can be temporarily attached to and used on the roof with the roofing nails used on the job. The power for cutting results from the housing of the cutting wheel being manually drawn back towards the operator. The shingle cutter has a structural base and two vertical end walls that support a rectangular rack, which holds the cutting block. In one version the rack drives a pinion, which in turn drives the cutting wheel. In a second version, the cutting wheel is free to rotate as it is pulled through the shingle. The cutting block is constrained by rollers in contact with the top and bottom of the rectangular guide bar so that the cutting wheel moves to perform a shearing function with an abutting shear ledge mounted on the structural base.

17 Claims, 7 Drawing Sheets

SHINGLE CUTTER

CROSS-REFERENCE TO RELATED APPLICATION

This application claims the benefit of U.S. Provisional Patent Application Ser. No. 60/201,759, filed May 4, 2000.

BACKGROUND OF THE INVENTION

1. Field of the Invention

The present invention relates to the building construction tools, and particularly to a shingle cutter which permits the on-site cutting of roofing shingles using a one-man operated machine.

2. Description of Related Art

A number of mechanical cutters and trimmers for producing fiber glass and asphalt roof shingles in a desired shape have been constructed and marketed, but most roofers have relied on a utility knife for cutting shingles in view of the knife's portability and simplicity.

Some shingle cutters are designed to produce particular kinds and shapes of shingles that are used in well-defined and specialized circumstances. For example, U.S. Pat. No. 4,951,540, issued to Cross et al., discloses a shingle ridge cap cutter used for cutting uniform sections from roof shingles. This cutter comprises a frame along which a shingle is guided under a manually operated cutter holding two blades with cutting edges positioned downward so that the cut shingle resembles a trapezoid adjoined to a rectangle so that the base of the trapezoid and a side of the rectangle coincide. Similarly, U.S. Pat. No. 5,052,256, issued to Morrissey, discloses a shingle cutting apparatus that produces a trapezoid-on-rectangle shingle used on ridge caps. The Morrissey cutter has grooves in the base into which the blades can fit.

Other patents deal with manufacturing processes that have also been applied to small scale applications. For example, U.S. Pat. No. 5,165,314, issued to Paulson et al., discloses the use of a rotating slitting blade. This devise is used to cut sheets of corrugated paperboard. Similarly, U.S. Pat. No. 5,322,001, issued to Boda, discloses a paper cutter using circular blades.

Several shingle cutters use a pivotal cutting blade. For example, U.S. Pat. No. 5,249,495, issued to Renk, discloses a pivotal cutter blade and anvil upon which the blade is mounted ins cooperation. A fence rotates in the plane of the base, so that angular cuts on a shingle can be made. Similarly, U.S. Pat. No. 5,787,781, issued to Hile, discloses a shingle cutter for cutting a straight even line and has a straight cutting edge pivotally mounted on a side and corner of the base. There is a bearing and lock nut disposed on a threaded rod and this combination keeps the blade tight against a support member recessed in the base. The base can be attached to legs.

U.S. Pat. No. 5,644,963, issued to Fountas, discloses a guide with no cutting edge.

It is apparent that no device other than a utility knife has gained wide-spread popularity for cutting and trimming shingles at the spot where the shingles are to be installed. Most of the devices are too cumbersome to be relocated on the roof or they are used only to perform specialized tasks. Recent changes in the manufacture of shingles from a single layer to a multi-layer shingle has made the hand cutting of shingles even more difficult than in the past further necessitating a cutting device which is efficient, easily portable, usable in place on a roof, and easily operated by a workman located on a roof slope.

None of the above inventions and patents, taken either singly, or in combination, is seen to describe the instant invention as claimed.

SUMMARY OF THE INVENTION

The shingle cutter according to the present invention is used to cut a shingle to produce a shingle having a desired size and shape. The shingle cutter is portable and can be temporarily attached to and used on a roof. The power for cutting results from the housing of the cutting wheel being manually drawn back towards the operator.

The shingle cutter has a structural base attached to two end upright pieces that support a rectangular rack or bar, upon which a cutting wheel housing moves in a sliding manner. In one embodiment, the teeth of the bottom edge of the rack engage the gear teeth of a pinion, which in turn engage a circle of gear teeth fixed with and concentric with the cutting wheel. In another embodiment, the cutting block is supported by a rectangular guide bar with no teeth on its bottom edge. The cutting wheel is rotatably mounted on an axle disposed in a cutting block housing which is slidable along the bar. In both embodiments, the cutting block housing slides along the rectangular bar on four rollers whose axes are perpendicular to and are held rigidly by the two cutting block housing plates.

Accordingly, it is a principal object of the invention to provide a device for producing an efficient and clean cut edge on roof shingles in order to produce custom cut roof shingles.

It is another object of the invention to provide a convenient and easy to operate mechanism for cutting shingles.

It is a further object of the invention to provide a shingle cutting mechanism that is transportable from job site to job site and from ground level to roof top of the building where roof work is being performed. The shingle cutter of the present invention can be temporarily attached to the roof by a slotted mounting tab.

Still another object of the invention is to provide a device for cutting shingles to produce a variety of shapes for a variety of roofing conditions. Another object of the invention is to accommodate recent changes in the manufacture of shingles from a single layer to a multiple layer. This has made the cutting of shingles more difficult. This change has created a need for a more efficient and easier method of cutting shingles.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a roofing tool in the form of a shingle cutter. A first embodiment of the present invention is depicted in FIGS. 1–3 and is generally referenced by numeral 10.

Figure 1:
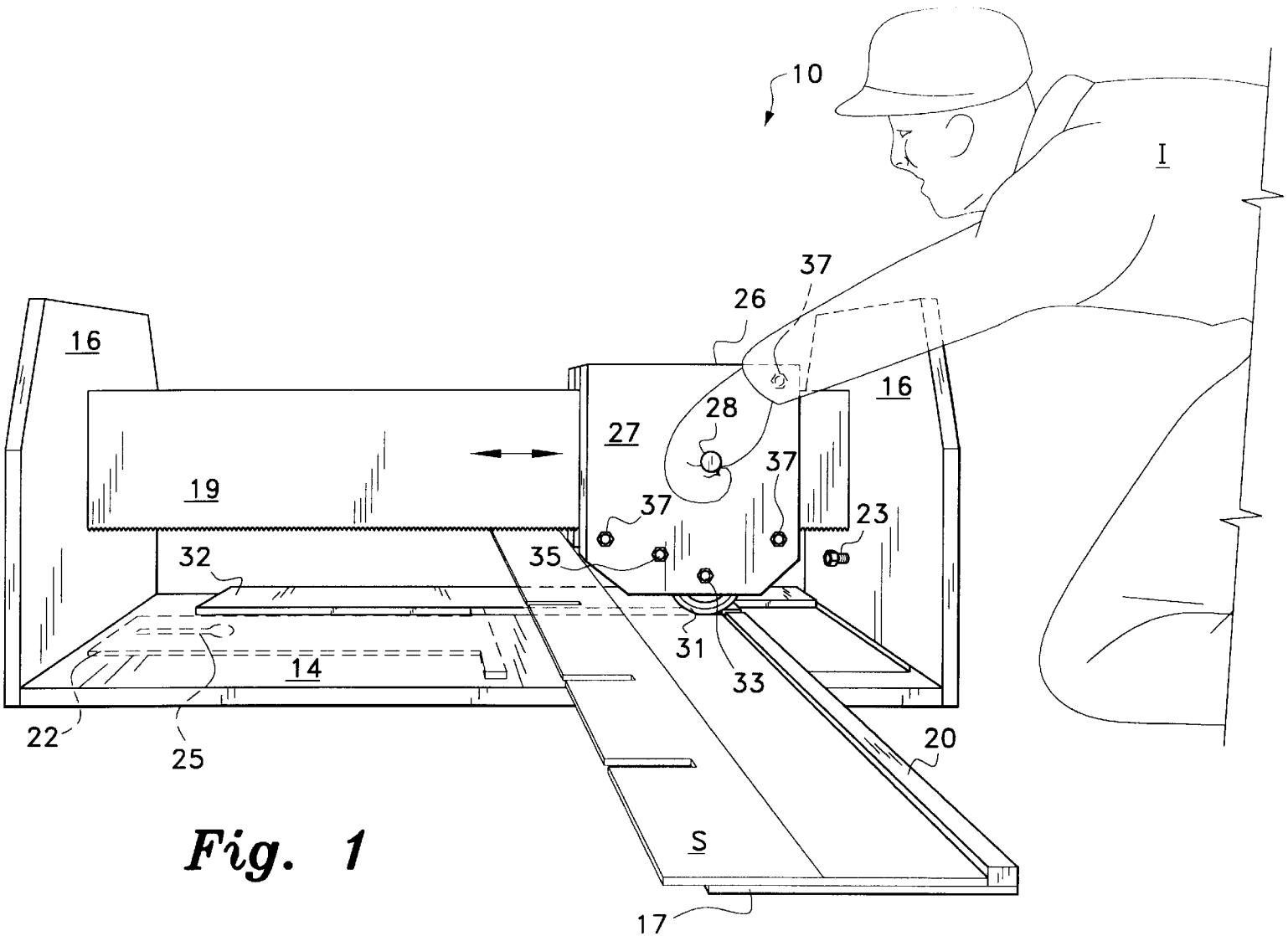
FIG. 1 is an environmental perspective view of a first embodiment of a shingle cutter according to the present invention.
Figure 2:
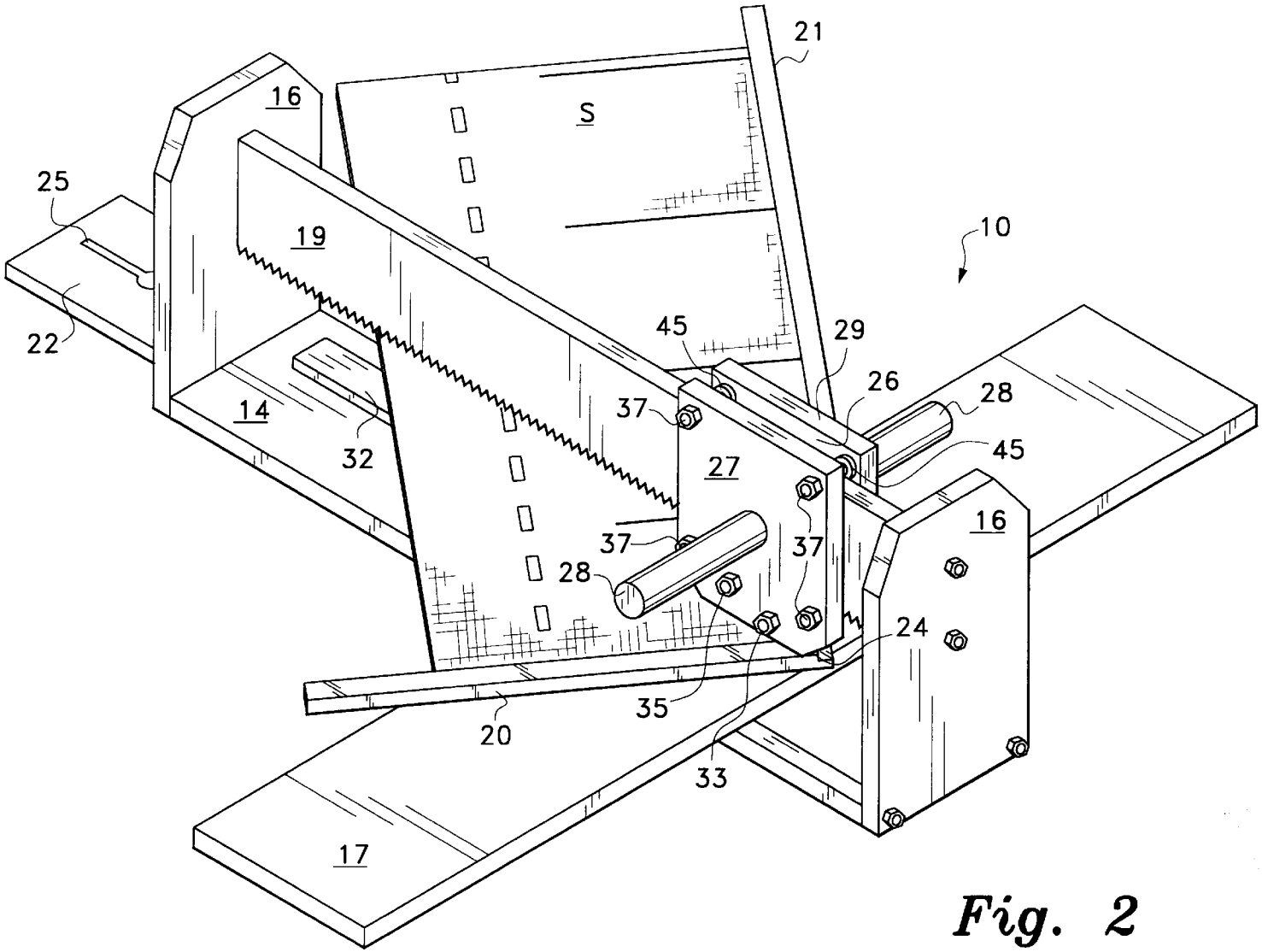
FIG. 2 is a front perspective view of the first embodiment of the shingle cutter showing pivoting right and left fences being used to align a shingle for cutting a shingle at an angle.

As generally illustrated in FIGS. 1–3, the shingle cutter 10 comprises a cutting block 26 that is mounted in a slidable manner on a rectangular rack 19. The rectangular rack 19 is fixedly attached to a U-shaped frame which includes a structural base 14 and rear and forward walls 16. The rectangular rack 19 is supported between the end walls 16 and spaced above a structural base 14 by a predetermined distance, the rack 19 being disposed in a plane normal to a plane in which the base 14 is disposed. The structural base 14 has a coplanar extension at a right angle to its length-wise dimension, hereinafter referred to as transverse base 17. This transverse base 17 serves as a flat area for placing the shingle while it is being worked on. The forward edge of the transverse base 17 has two fences, 20 and 21, that may be pivoted about pins 24 on the plane of the bases 17 and 14 and serve as a stop to prevent sliding of the shingle S during cutting. Although FIG. 1, for purposes of economy of illustration, depicts the operator cutting the shingle S in a direction moving away from the operator, the preferred method of operation is to position cutting block 26 at a point on rack 19 past the shingle S to be cut and then pull block 26 toward the operator I , thus cutting the shingle S. This is preferable in that fence 20 serves as a stop to avoid sliding of the shingle S.

The most externally conspicuous features of the cutting block 26 are the lower portions of the cutting wheel 31, the right 27 and left 29 cutting block housing panels, and the right and left cutting block handles 28. Aside from the handles, the most noticeable features on the panels 27 and 29 are the holes that accommodate the threaded ends of wheel axles, 52, 66, and 70 (shown in FIG. 3). A flat, elongated plate or shear ledge 32 is mounted on the structural base 14 such that one edge abuts the path of the cutting wheel 31. The edge of the cutting wheel shear ledge 32 and the cutting wheel 31 coact in the same way each blade of a pair of scissors would cut or shear through a piece of material.

An elongated tab with a hole and slot 25 defined therein forms roof anchor 22, which is used to anchor the shingle cutter to the roof by placing the hole portion of the hole and slot 25 of the tab 22 over the head of a nail attached to the roof and sliding the shaft of the nail into the slot. The roof anchor 22 is slidably mounted to the base 14 so that the anchor 22 can be retracted into a hollow space in the structural base 14 when the shingle cutter 10 is not in use. Two widened portions (not shown) on the end of the roof anchor 22 prevent the anchor from being pulled free of the shingle cutter 10. The environmental perspective view of FIG. 1 shows an installer I cutting a shingle S by pulling the cutting block 26 by its handles, 28. The shingle S is supported by the right 20 and left 21 pivotal fences as the cutting wheel 31 is drawn across the shingle S.

Figure 4:
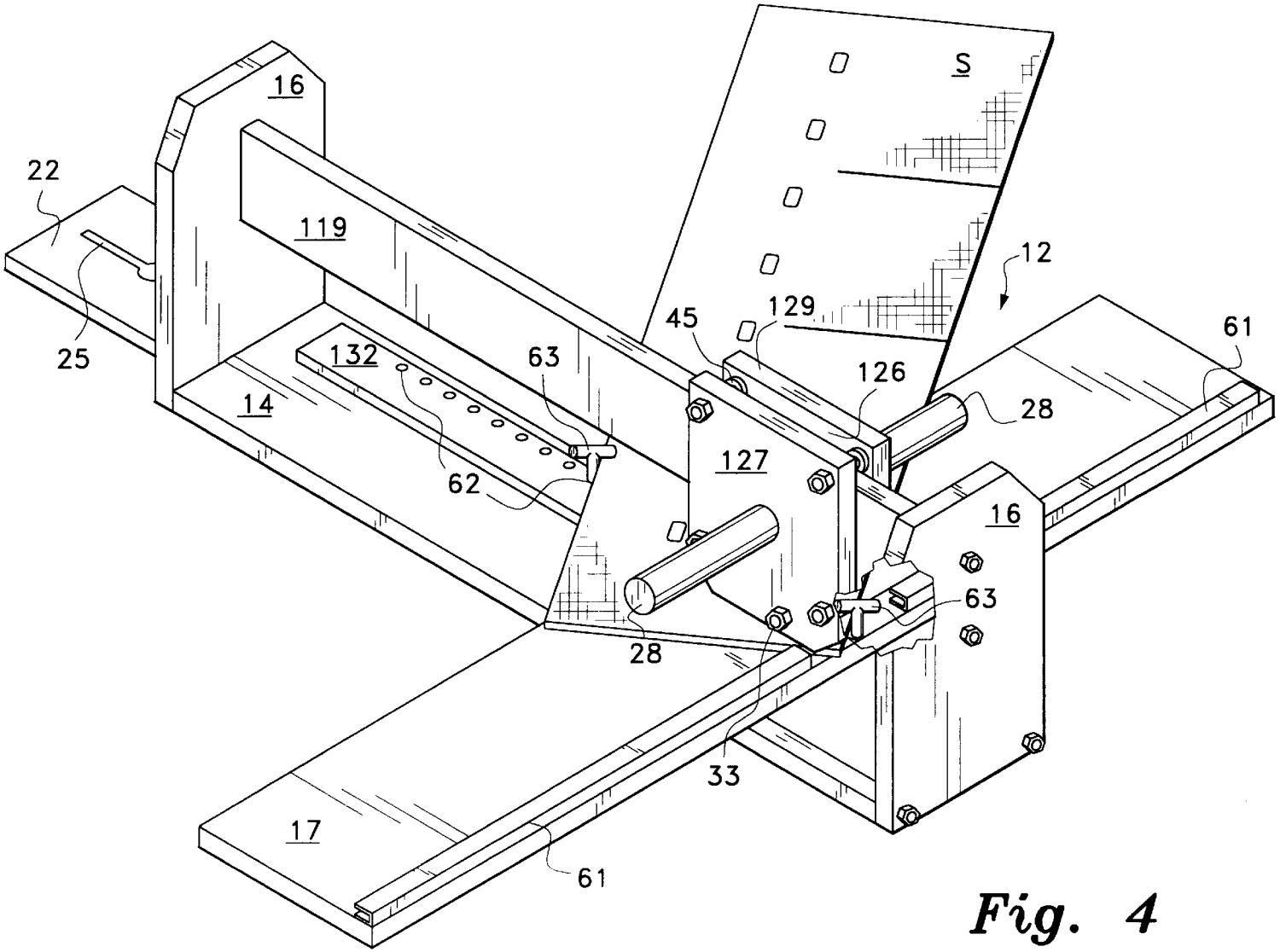
FIG. 4 is a front perspective view of a second embodiment of the shingle cutter, featuring an alternative method using pegs for maintaining the shingle aligned in an angular position relative to the path of the cutting wheel.
Figure 5:
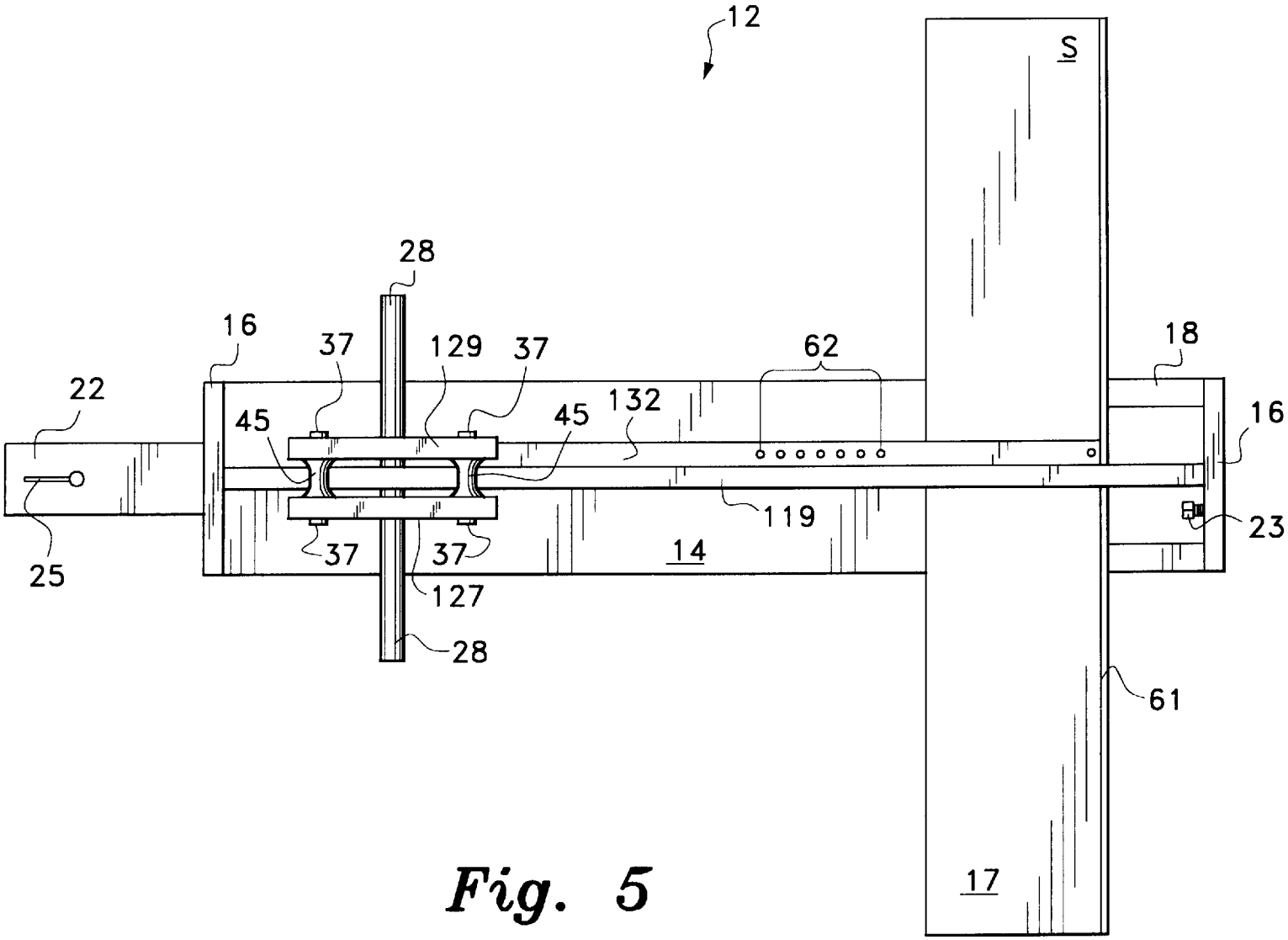
FIG. 5 is a top view of the second embodiment of a shingle cutter according to the present invention.
Figure 6:
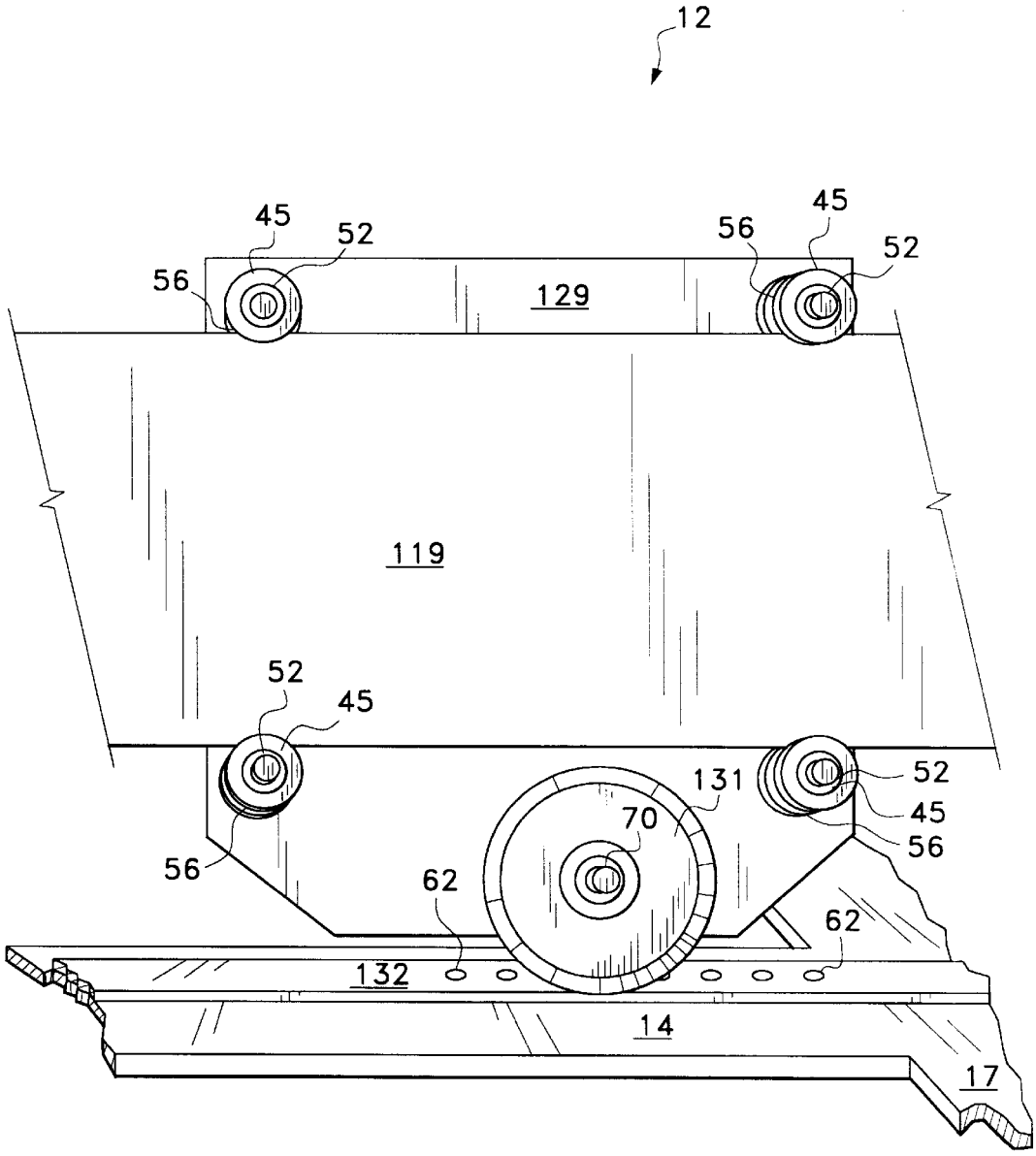
FIG. 6 is a fragmented side perspective view of the second embodiment of the shingle cutter with part of the cutting block housing removed.

A second embodiment of the present invention is depicted in FIGS. 4–6 and is generally referenced by numeral 12.

The second embodiment of the shingle cutter 12, comprises the same or similar components as those of the shingle cutter 10 of the first embodiment. As shown in FIGS. 4–5, the shear ledge 132 may have a series of holes 62 into which shingle guiding pegs 63 are inserted. In the second embodiment, a fixed transverse back fence 61 is permanently fixed to the forward edge of the transverse base 17. A cutter block bumper guard 23 projects from the forward end wall 16 in order to prevent the cutting block from bumping against the end wall 16 in both the first 10 and second 12 embodiments of the shingle cutter.

A side view of the cutting block 126 with the right panel 127 removed to show details of the cutting block 126 in FIG. 6 permits comparison of the first 10 and second 12 embodiments of the shingle cutter. Similar cutaway views are shown for the first embodiment in FIGS. 3A–3C. In both embodiments, the cutting block 26 or 126 is supported on the rack 19 or 119 by a plurality of roller wheels 45 which are rotatably mounted on axles 52. Axles 52 are fixedly mounted to extend between plates 27 and 29 (127 and 129 in the second embodiment) and secured by axle nuts 37. Each roller wheel 45 has a groove 56 or neck defined therein slightly greater than the thickness of the rack 19 or 119 so that the roller wheels 45 roll along the rack as the cutting block is pulled or pushed, the grooves 56 preventing lateral movement of the cutting block as it rolls along the rack. The roller wheels 45 may have a plurality of O-rings (not shown) disposed in the groove 56 to decrease rolling friction between the roller wheels 45 and the rack. The roller wheels 45 maintain the plates and in spaced apart relation.

Figure 3A:
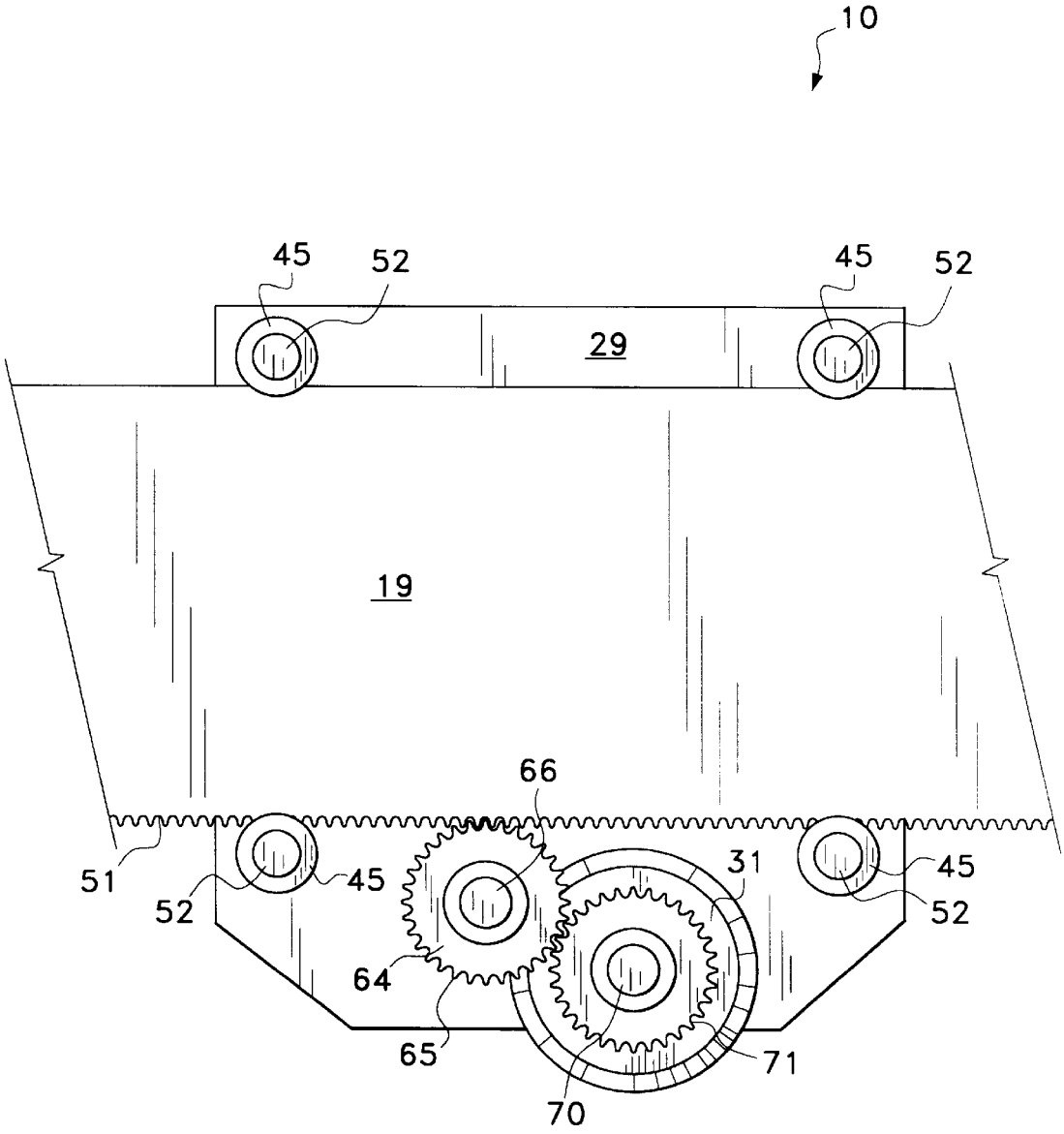
FIG. 3A is a side elevation view of the first embodiment of the shingle cutter with part of the cutting block housing removed.

AS shown in FIG. 3A, in a first embodiment the bottom edge of the rack has a plurality of gear teeth 51 defined therein which engage the gear teeth 65 of a pinion 64 which is rotatably mounted on axle 66, which extends between plates 27 and 29 and is secured by nuts 35 (only one shown). Cutting wheel 31 is rotatably mounted on axle 70, which is fixedly mounted between plates 27 and 29 and secured by nuts 33 (only one shown). The teeth of the pinion 64 engage the teeth of gear 71, which is fixedly attached to cutting wheel 31. Therefore, as the cutting block is pushed or pulled along rack 19, pinion 64 drives gear 71, causing cutting wheel 31 to rotate.

As shown in FIG. 6, in a second embodiment the bottom edge of rack 119 is smooth and has no gear teeth. The second embodiment includes roller wheels 45 as described above, but pinion 64 and gear 71 are absent. Cutting wheel 131 is rotatable mounted on axle 70 and rotates by frictional engagement of the edge of the cutting wheel 131 with the shingle S or other workpiece.

Figure 3B:
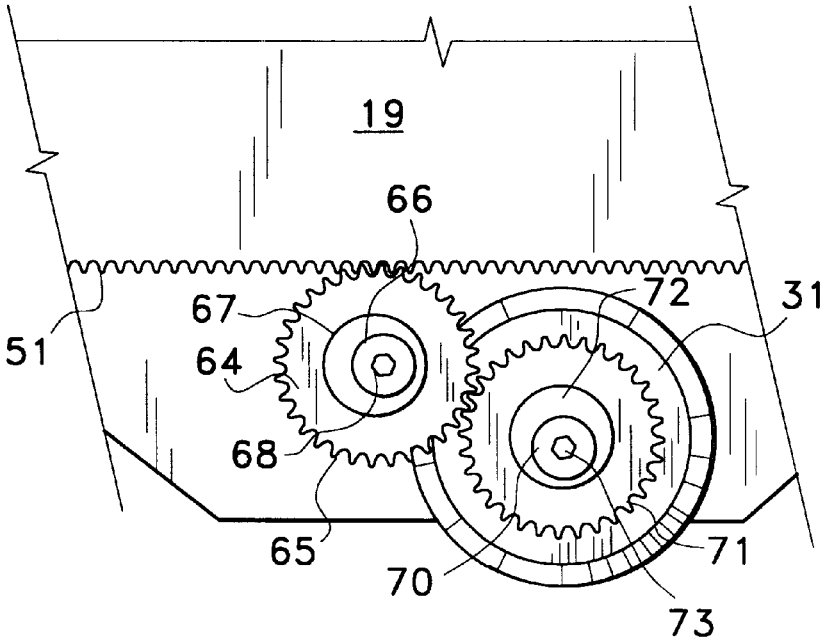
FIG. 3B is a detail view of the shingle cutter of FIG. 3A showing the pinion gear and cutting wheel and its driving gear adjusted so as to place the cutting wheel in a raised position.
Figure 3C:
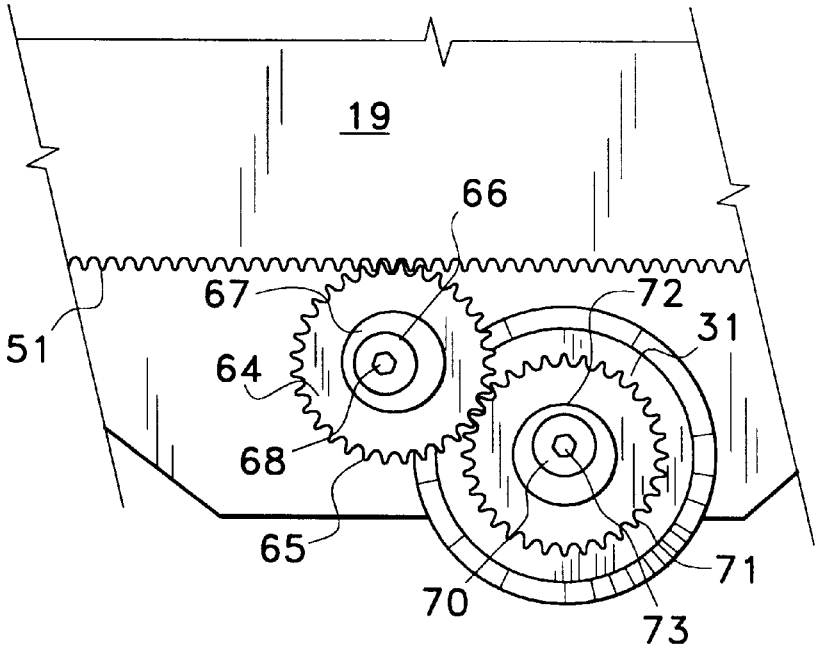
FIG. 3C is a detail view of the shingle cutter of FIG. 3A showing the pinion gear and cutting wheel and its driving gear adjusted so as to place the cutting wheel in a lowered position.

Referring to FIGS. 3B and 3C, in either the first or second embodiment, the height of the cutting wheel 31 or 131 may be made adjustable as follows. The axle 70 may include a cylindrical hub 72 mounted between the ends of the axle 70. The cutting wheel may be rotatably mounted on the hub 72. The hub 72 may be eccentrically mounted on the axle 70. The end of the axle 70 may have a fitting 73, such as an Allen head, so that the axle 70 may be rotated in its mounting holes. This raises and lowers the cutting wheel to adjust for different shingle thickness and depth of cut.

In the first embodiment, in order to compensate for movement of cutting gear wheel movement as cutting wheel 31 is raised upwardly or lowered downwardly to accomplish differing depth cuts, it may be necessary to mount pinion gear 64 in a manner similar to cutting wheel 31 in order to maintain proper mesh of its gear teeth with cutting wheel gear 71 while maintaining proper mesh with the gear teeth 51 along the lower edge of rectangular rack 19. The axle 66 may include a cylindrical hub 67 mounted between the ends of the axle 66. The pinion gear may be rotatably mounted on the hub. The hub may be eccentrically mounted on the axle 66. The end of the axle 66 may have a fitting, such as an Allen head 68, so that the axle 66 may be rotated in its mounting holes. This allows adjustment of the pinion gear 64 to maintain proper mesh with the cutting wheel gear 71 as the cutting wheel 31 is raised or lowered. Alternatively, the gear teeth of pinion 64 and cutting wheel gear 71 may be so designed so as to allow adequate meshing of the gears as cutting wheel 31 and its gear 71 as it is raised or lowered within a limited range so as to effectively turn cutting wheel 31. In the second embodiment there are no gears or pinion so that the cutting wheel may be raised or lowered as described above without the need to manipulate gears for adequate meshing since the second embodiment employs no gears for operation.

As generally illustrated in FIG. 2, in a first embodiment, the shingle cutter 10 is shown cutting a shingle S using one or both pivotal fences 20 and 21 in order to make an angular cut. The right fence 20 rotates about the right pivotal fence pivot pin 24 to provide a reference position on the right end of the shingle S. The left fence 21 rotates about the left pivotal fence pivot pin (not shown) to provide a reference position on the forward long side of a shingle S. The positions of the rotated fences are associated with the particular angle at which the shingle S is being cut as long as the given sides of the shingle S are flush with their corresponding pivotal fences 20 and 21.

As illustrated in FIG. 4, in a second embodiment, the shingle cutter 12 is shown cutting a shingle S using the pegs 63 and the peg holes 62 along a segment of the cutting wheel shear ledge 132 to orient the shingle S in order to make an angular cut. In FIG. 4, part of the apparatus is cut away to reveal the forward-most peg 63 located in forward-most peg hole 62 between both sections of the back fence 61. The holes bored to hold the peg second closest to the operator are so placed that the direction of the width of the shingle S relative to the cutting direction corresponds to a predetermined angle. The line between the two pegs, which is parallel to the cutting line, is the hypotenuse of a right triangle of which the width of the shingle S represents a side. The distance between the positions of the pegs 63 is determined by the inverse of trigonometric functions for predetermined angles. Although a multiplicity of peg holes 62 are illustrated in FIGS. 4 and 6, the preferred number of peg holes 62 is four, corresponding to standard angle cuts in the industry. A standard spring-loaded clamp(not shown) may be attached where convenient such as near the intersection of the shingle S and transverse base 17 to assist in holding in place shingle S against transverse base 17 while the cutting operation is performed.

It is to be understood that the present invention is not limited to the sole embodiments described above, but encompasses any and all embodiments within the scope of the following claims.

I claim:

1. A shingle cutter for cutting roof shingles, comprising:

a) a U-shaped frame having an elongated, planar base having a top surface, an upright forward wall attached to a first end of the base, and an upright rear wall attached to a second end of the base;

b) a transverse base attached to the base of the U-shaped frame adjacent the forward wall, the transverse base having a top surface coplanar with the top surface of the base of said U-shaped frame;

c) a flat, planar, rectangular rack extending between the forward wall and the rear wall and having a substantially constant thickness, the rack being disposed in a plane normal to a plane in which the base is disposed, the rack being disposed above the base of said U-shaped frame by a predetermined distance;

d) a cutting block movably disposed on said planar rack;

e) a cutting wheel rotatably mounted on said rack, the cutting wheel having a cutting edge extending between said rack and the base of said U-shaped frame in order to cut a shingle placed on the top surface of the base; and f) an elongated, planar shear ledge mounted on the base of said U-shaped frame, the ledge having an edge abutting a side of said cutting wheel and a plurality of peg holes defined therein for receiving pegs to hold the shingle at a predetermined angle.

2. The shingle cutter according to claim 1, wherein said cutting block further comprises:

a) a first plate;

b) a second plate;

c) a plurality of roller wheel axles extending between said first plate and said second plate;

d) a plurality of roller wheels rotatably mounted on said, roller wheel axles, each of said wheels having a circumference and a groove defined therein about said circumference, the groove being slightly greater than the thickness of said rack; and e) said cutting block being mounted on said rack with the rack in the grooves of said roller wheels and said first plate and said second plate disposed on opposite sides of said rack.

3. The shingle cutter according to claim 2, wherein said cutting wheel is rotatably mounted on said rack by an axle extending between said first plate and said second plate and below said rack.

4. The shingle cutter according to claim 3, wherein said cutting wheel axle is vertically adjustable relative to said rack, and said planar base thereby providing for said cutting wheel to cut within a range of shingle thicknesses and depth of cut.

5. The shingle cutter according to claim 4, further comprising:

a) a cutting wheel cylindrical hub mounted between first and second ends of said cutting wheel axle;

b) said first and second plates defining opposing mounting holes for said cutting wheel axle located therein; and c) a fitting on one of said ends of said cutting wheel axle for enabling manual rotation thereof;

d) said cutting wheel hub being mounted eccentrically on said cutting wheel axle;

e) said cutting wheel being rotatably mounted on said cutting wheel cylindrical hub;

whereby said cutting wheel is raised or lowered relative to said cutting block by rotating said cutting wheel axle relative to said cutting block by manual rotational adjustment of said fitting.

6. The shingle cutter according to claim 5, further comprising:

a) a pinion having a pinion cylindrical hub mounted between first and second ends of a pinion axle;

b) said first and second plates defining opposing mounting holes for said pinion axle located therein; and c) a fitting on one of said ends of said pinion axle for enabling manual rotation thereof;

d) said pinion hub being mounted eccentrically on said pinion axle;

e) said pinion being rotatably mounted on said pinion cylindrical hub;

whereby said pinion may be adjusted relative to said rack and a cutting wheel driven gear by rotating said pinion axle relative thereto by manual rotational adjustment of said fitting to maintain adequate meshing of said pinion with said rack and said cutting wheel driven gear.

7. The shingle cutter according to claim 6, wherein said fitting is an Allen head.

8. The shingle cutter according to claim 2, further comprising a pinion rotatably mounted on said rack by an axle extending between said first plate and said second plate and below said rack and a fitting on an end of said pinion axle for enabling manual rotation thereof.

9. The shingle cutter according to claim 8, wherein said fitting is an Allen head.

10. The shingle cutter according to claim 1, wherein said rack has a bottom edge having a plurality of gear teeth defined therein, the shingle cutter further comprising:

a) a pinion rotatable mounted on said cutting block, the pinion having a plurality of gear teeth engaging the gear teeth defined in said rack; and b) a driven gear fixedly attached to said cutting wheel, the driven gear having a plurality of gear teeth engaging the gear teeth of said pinion, whereby said cutting wheel is driven to rotate when said cutting block is moved along said, rack.

11. The shingle cutter according to claim 1, further comprising at least one handle mounted on said cutting block.

12. The shingle cutter according to claim 1, further comprising at least one fence mounted on said transverse base.

13. The shingle cutter according to claim 1, further comprising two pegs, one of the two pegs being removably located in a location near said forward wall and the other of said two pegs being removably located in a selected one of said plurality of peg holes, the location of each of said plurality of peg holes corresponding to a cutting angle which is standard in installing roofing shingles.

14. The shingle cutter according to claim 1, further comprising fixing means for temporarily fixing the shingle cutters to a roof.

15. The shingle cutter according to claim 14, wherein said fixing means comprises a planar roof anchor storable within said planar base of said U-shaped frame and having a through hole communicating with a slot whereby upon deployment of said roof anchor by sliding said anchor from a stored position within said planar base to a deployed position, said through hole may be fitted over a nail disposed in said roof and said anchor may be moved into a secure position by moving said anchor relative to said nail such that the nail becomes lodged within said communicating slot.

16. The shingle cutter of claim 1, further comprising a cutter block bumper guard located in said forward wall and so located as to provide a stop for said movably disposed cutting block.

17. A shingle cutter for cutting roof shingles, comprising:

a) a U-shaped frame having an elongated, planar base having a top surface, an upright forward wall attached to a first end of the base, and an upright rear wall attached to a second end of the base;

b) a transverse base attached to the base of the U-shaped frame adjacent the forward wall, the transverse base having a top surface coplanar with the top surface of the base of said U-shaped frame;

c) a flat, planar, rectangular rack extending between the forward wall and the rear wall and having a substantially constant thickness, the rack being disposed in a plane normal to a plane in which the base is disposed, the rack being disposed above the base of said U-shaped frame by a predetermined distance;

d) a cutting block movably disposed on said planar rack;

e) a cutting wheel rotatably mounted on said rack, the cutting wheel having a cutting edge extending between said rack and the base of said U-shaped frame in order to cut a shingle placed on the top surface of the base; and f) a planar roof anchor storable within said planar base of said U-shaped frame and having a through hole communicating with a slot whereby upon deployment of said roof anchor by sliding said anchor from a stored position within said planar base to a deployed position, said through hole may be fitted over a nail disposed in said roof and said anchor may be moved into a secure position by moving said anchor relative to said nail such that the nail becomes lodged within said communicating slot.

* * * * *